United States Patent [19]

Curtis

[11] Patent Number: 4,489,810

[45] Date of Patent: Dec. 25, 1984

[54] RECESSED GARBAGE CAN CONTAINER

[76] Inventor: Joel E. Curtis, 306 Christopher, Chickasha, Okla. 73018

[21] Appl. No.: 524,490

[22] Filed: Aug. 19, 1983

[51] Int. Cl.[3] ..... B65D 43/26; B65D 88/54; B65D 9/00

[52] U.S. Cl. ..... 187/3; 187/62; 220/211; 220/263; 220/409

[58] Field of Search ..... 220/409, 211, 263, 329, 220/331, 333; 187/5, 3, 65, 64, 62, 20, 95; 49/346, 339, 345, 340, 386

[56] References Cited

U.S. PATENT DOCUMENTS

| | | | |
|---|---|---|---|
| 93,452 | 8/1869 | Kiser | 187/3 |
| 270,340 | 1/1883 | Rose | 49/346 |
| 300,685 | 6/1884 | Borst | 220/409 X |
| 329,129 | 10/1885 | Borst | 187/62 X |
| 606,057 | 6/1898 | Hayes | 49/346 |
| 1,170,193 | 2/1916 | Rutan | 187/62 |
| 3,085,655 | 4/1963 | Van Dyk | 187/5 |
| 3,356,183 | 12/1967 | Shell | 187/3 |
| 3,614,994 | 10/1971 | Goodrum | 187/95 X |

FOREIGN PATENT DOCUMENTS

| | | | |
|---|---|---|---|
| 578647 | 7/1946 | United Kingdom | 49/345 |

*Primary Examiner*—Allan N. Shoap
*Attorney, Agent, or Firm*—Robert K. Rhea

[57] ABSTRACT

In a concealed garbage can container an upwardly open housing, having a hinged lid for containing one or more refuse containers, is recessed into the surface of the earth so that only its lid is exposed. A refuse can supporting platform within the housing is moved vertically by a winch driven reversible motor to raise and lower the platform. Pivoting links, extending between the platform and lid, simultaneously opens and closes the lid with vertical movement of the platform. Rollers, mounted on the platform engaging housing supported standards, maintain the platform horizontal during its vertical movement.

3 Claims, 5 Drawing Figures

RECESSED GARBAGE CAN CONTAINER

BACKGROUND OF THE INVENTION

1. Field of the invention

The present invention relates to refuse containers and more particularly to a recessed garbage can container.

It is desirable from an environmental standpoint to secure garbage cans usually disposed adjacent a curb for pickup and emptying. Garbage cans, even with lids in place, thus placed in the evening for a next day pickup, are subject to being overturned by the wind or animals and the garbage and paper is strewn over the landscape.

This invention eliminates such unsightly and unsanitary results.

2. Description of the prior art

It is known to recess a housing or shell into the surface of the earth for surrounding all or the major portion of a garbage can with its lid adjacent the surface of the earth, however, this has the disadvantage of necessitating lifting a filled garbage can out of the recess in order to properly dispose of the refuse therein. It is also known to employ a manually operated lever arrangement to lift or at least partially lift the garbage can out of its well. However, such devices have not come into general use principally for the reason, it is believed, they have not been too successful in operation and maintenance.

This invention provides a housing adapted to hold one or a plurality of garbage cans in which the housing is recessed into the surface of the earth and provided with an electrically operated winch mechanism which lifts a filled garbage can from a recessed to an upwardly disposed position for ease in removing the garbage can from its housing.

SUMMARY OF THE INVENTION

A generally rectangular hollow housing, having a hinged lid, adapted to surround at least one garbage can is recessed in the surface of the earth with its lid adjacent the surface thereof. An elevatable grid-like horizontal platform, within the housing, is connected with a roller arrangement and guided vertically by a pair of standards extending from the top to the bottom of the housing. The platform is moved upwardly and lowered by blocks and tackle secured to a reversible electric motor operated winch contained by the housing. Pivoting lever arms, extending between and connected with the housing and platform, move a lid lifting wheel against the inner surface of the lid to raise and lower the lid in response to vertical movement of the platform.

The principal objects of this invention are to provide a recessed garbage can container which will secure a garbage can therein and which opens the housing lid and elevates the garbage can to an easy accessible position in response to energizing an electric motor driven winch operatively connected with a can supporting platform within the housing.

DESCRIPTION OF THE PREFERRED EMBODIMENT

Figure 2:
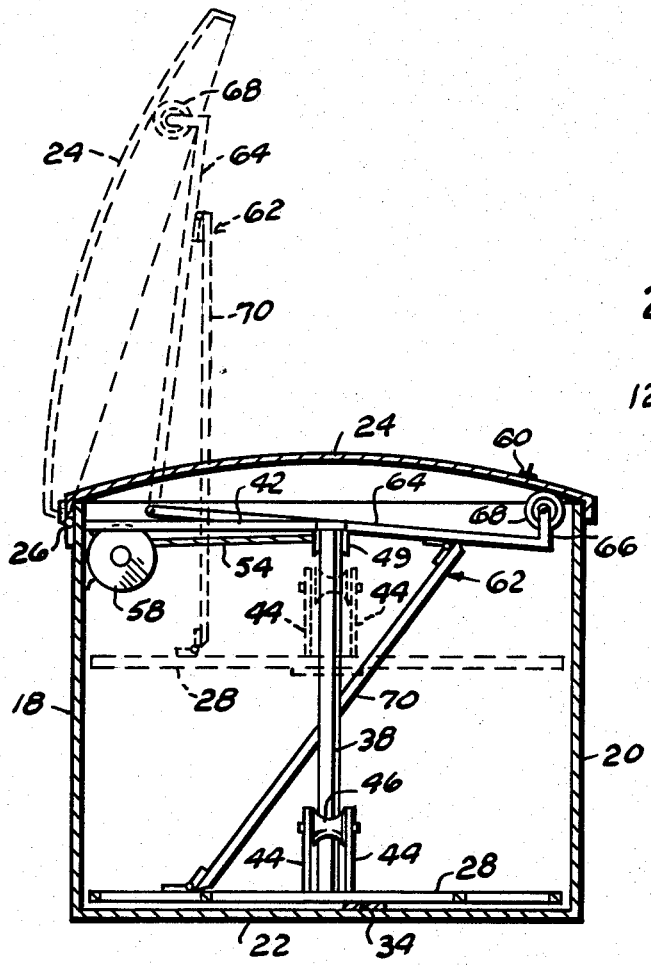
FIGS. 2 and 3 are vertical cross sectional views, to a larger scale, taken substantially along the lines 2—2 and 3—3, respectively, of FIG. 1 and illustrating the container lid in elevated position by dotted lines.
Figure 1:
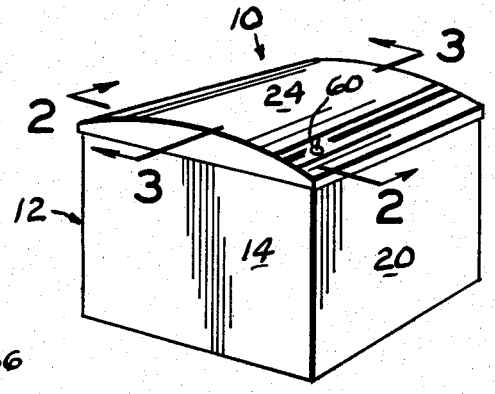
FIG. 1 is a perspective view of the garbage can container.
Figure 4:
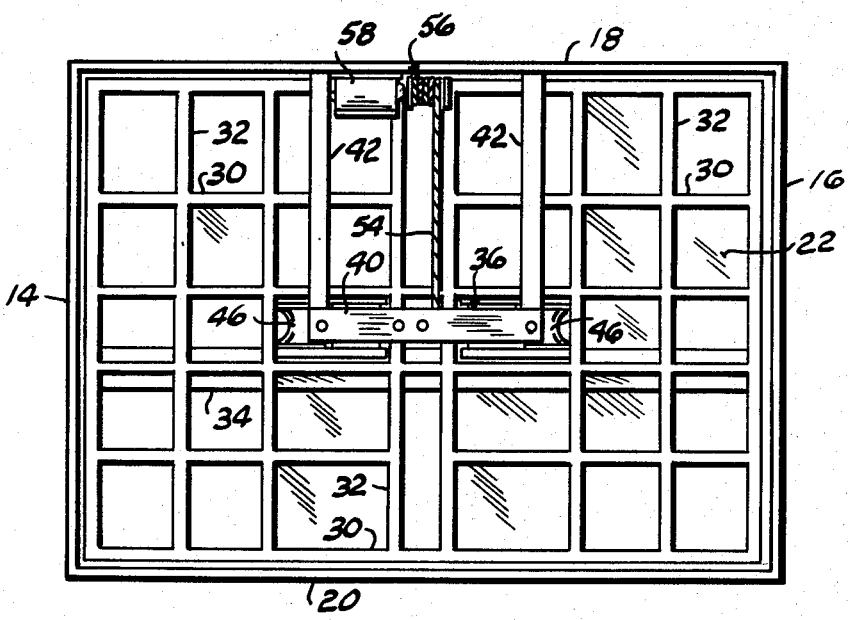
FIG. 4 is a top view of the container with the lid removed.
Figure 3:
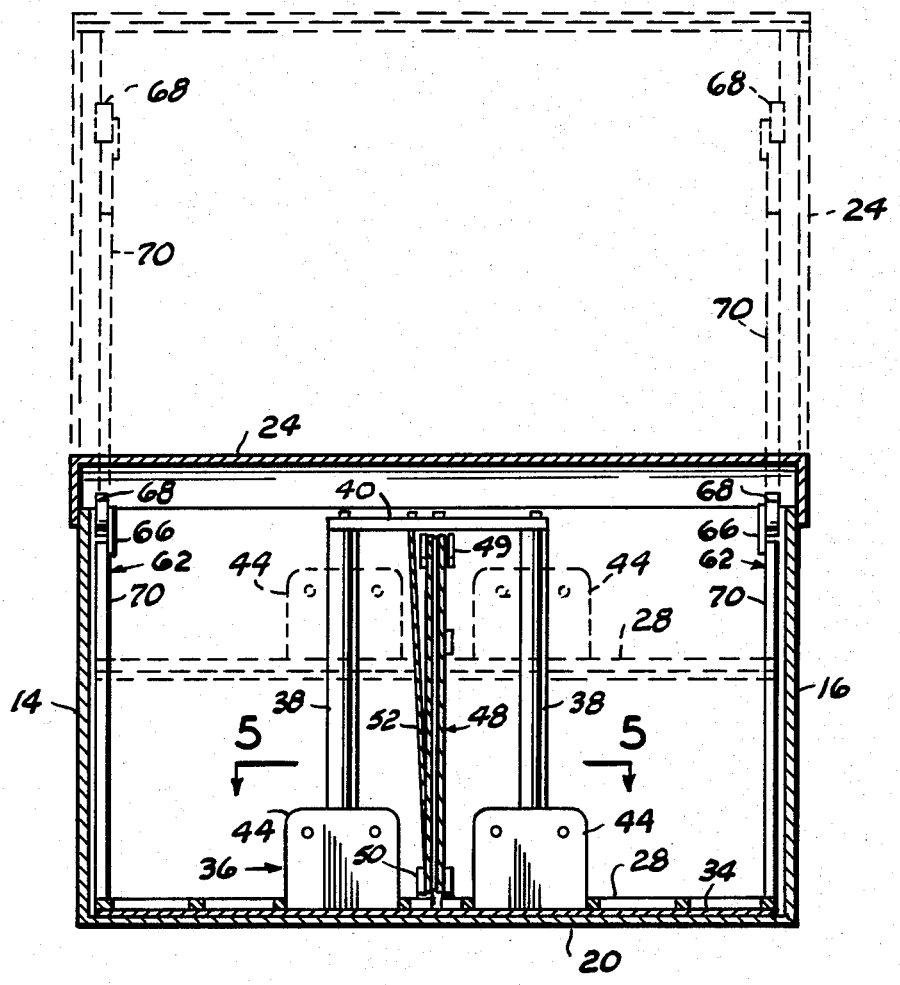
Figure 5:
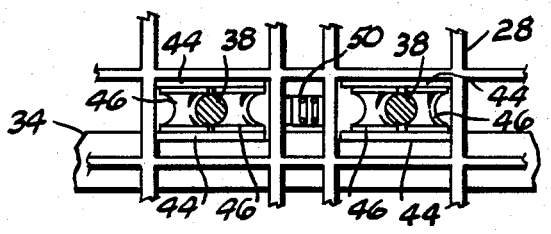
FIG. 5 is a fragmentary horizontal cross sectional view, partially in elevation, taken substantially along the line 5—5 of FIG. 3.

Like characters of reference designate like parts in those figures of the drawings in which they occur.

In the drawings:

The reference numeral 10 indicates the garbage can container which is rectangular box-like in general configuration comprising a housing 12 having end walls 14-16, a back wall 18, a front wall 20, a bottom 22 and a lid 24 connected with the back wall by hinges 26. The lid 24 is preferably bowed arcuately upward from front to back. The housing 12 is dimensioned to contain at least one and preferably a plurality of garbage cans or other refuse containers, not shown. A generally planar grid-like movable ramp or platform 28, preferably formed by a plurality of longitudinally and transversely extending members 30 and 32, is dimensioned to be loosely received horizontally by the inner wall surface of the respective end and side walls of the container housing. An elongated platform support plate 34 longitudinally underlies the platform 28 substantially medially its width.

Guide means 36 is mounted on the plate 34 for guiding the platform and maintaining it parallel with the container bottom wall 22. The guide means 36 comprises a pair of vertical rod-like standards 38 secured at their depending ends on the bottom wall 22 in parallel longitudinally spaced relation medially the width of the platform 28 and terminating at their upper limit adjacent the upper limit of the housing. The upper ends of the standards 38 are interconnected by a cross brace 40 in turn connected at its respective ends with a pair of lateral braces 42 secured to the upper edge portion of the back wall 18.

Two pairs of upstanding roller plates 44 are secured at their depending ends in parallel spaced relation to the platform plate 28 on opposing front to rearward sides of the respective standard 38 and respectively journal, adjacent their upper limit, a pair of guide rollers 46 rollably contacting the respective standard. Obviously, the guide means 36 may be located adjacent the front or back housing wall, if desired.

Block and tackle means 48 includes a top block 49 centrally secured to the standard brace 40 and a bottom block 50 secured to the platform 28 in cooperative vertical alignment with the top block with a flexible element, such as a cable 52, anchored at its dead end to the top brace 40 and entrained around the pulleys of the respective blocks. The free end portion 54 of the cable is wound on a winch 56 centrally mounted on the housing back wall 18 medially its length and adjacent its upper limit. The winch 56 is connected with and operated by a reversible motor 58 similarly mounted on the inner surface of the back wall 18. Obviously, the motor and winch may be mounted exteriorly of the back wall 18 and the cable end portion 54 entrained through an opening therein, not shown.

A motor switch 60, mounted on the lid 24, is connected by wiring with a source of electrical energy, neither being shown, for energizing the motor 58. Obviously, the switch or other motor controls may be located remote from the device 10, if desired.

Linkage means 62 raises and lowers the lid 24 in response to vertical movement of the platform 28. The linkage means 62 comprises a pair of arms 64 pivotally connected at one end adjacent the upper limit of the respective end wall 14 and 16 adjacent the back wall 18. The arms 64 are substantially L-shaped with the respective foot portion 66 disposed upwardly adjacent the front wall 20 and journalling a roller or wheel 68 rollably contacting the arcuate inner surface of the lid 24 adjacent its forward limit. The linkage further includes a pair of elongated legs 70 pivotally connected at their respective ends with the respective arms 64 adjacent the wheel 68 and with the platform 28 adjacent the back wall 18.

OPERATION

In operation, the container 10 is recessed in the surface of the earth 75 so that only its lid 24 is exposed. The motor is operated in one direction for winding the cable 52 on the winch 56 which lifts the platform and lid and any garbage can supported by the platform to the dotted line position. After placing garbage therein or emptying the garbage can the motor is reversed which pays out the cable to allow gravity return of the platform and lid to the downward solid line position of the drawings.

Obviously the invention is susceptible to changes or alterations without defeating its practicability. Therefore, I do not wish to be confined to the preferred embodiment shown in the drawings and described therein.

I claim:

1. A concealed garbage can container, comprising:

an upwardly open housing having end walls, a bottom wall and a hinged lid;

platform means within said housing normally disposed adjacent the bottom wall for supporting at least one refuse container;

means including a winch for vertically moving said platform;

guide means for maintaining said platform parallel with said bottom wall during vertical movement, said guide means including a pair of spaced-apart upright parallel standards secured to said housing bottom wall, a cross brace extending between the upper limit of said standards, guide means on said platform engaging said standards for guiding said platform during vertical movement, block and tackle means extending between said brace and the platform, and, a motor driven winch connected with the block and tackle means; and, link means for raising and lowering said lid in response to vertical movement of said platform, said link means including an arm pivotally connected at one end with one of said end walls adjacent the hinged connection of said lid and projecting toward the opposite limit of said lid, a wheel journalled by the other end portion of said arm, and, a leg extending between and pivotally connected at its respective end portions with said arm and said platform.

2. The garbage can container according to claim 1 in which the guide means includes:

a pair of upstanding parallel spaced-apart roller plates secured to said platform on opposing sides of the respective said standard; and, a pair of rollers journalled between said roller plates in rolling contact with the respective said standard.

3. The garbage can container according to claim 2 and further including:

lateral braces securing the upper limit of said standards to said housing; and, motor control means connecting said motor with a source of electrical energy.

* * * * *